US007458130B1

(12) United States Patent
Krymsky et al.

(10) Patent No.: US 7,458,130 B1
(45) Date of Patent: Dec. 2, 2008

(54) CLOSED LOOP VACUUM CLEANER

(76) Inventors: Mark D. Krymsky, 412 Whittier Dr., Langhorne, PA (US) 19053; Eugene Finkel, 412 Whittier Dr., Langhorne, PA (US) 19053

( * ) Notice: Subject to any disclaimer, the term of this patent is extended or adjusted under 35 U.S.C. 154(b) by 681 days.

(21) Appl. No.: 10/796,928

(22) Filed: Mar. 10, 2004

(51) Int. Cl.
*A47L 9/02* (2006.01)
*A47L 5/14* (2006.01)

(52) U.S. Cl. ..... 15/346; 15/345; 15/359

(58) Field of Classification Search ..... 15/345, 15/346, 359, 354, 362, 351; *A47L 5/14*
See application file for complete search history.

(56) References Cited

U.S. PATENT DOCUMENTS

| | | | | | |
|---|---|---|---|---|---|
| 2,018,791 | A | * | 10/1935 | Kern | 15/345 |
| 2,898,621 | A | * | 8/1959 | Vance | 15/359 |
| 3,694,848 | A | | 10/1972 | Alcala | |
| 3,931,662 | A | * | 1/1976 | Nayfa et al. | 15/346 |
| 4,219,902 | A | | 9/1980 | De Maagd | |
| 4,446,594 | A | | 5/1984 | Watamabe et al. | |
| 4,853,008 | A | | 8/1989 | Dyson | |
| 4,884,315 | A | | 12/1989 | Ehnert | |
| 5,168,599 | A | | 12/1992 | Williams | |
| 5,553,347 | A | | 9/1996 | Inoue et al. | |
| 5,613,269 | A | | 3/1997 | Miwa | |
| 5,908,493 | A | | 6/1999 | Krymsky | |
| 6,032,327 | A | | 3/2000 | Oka et al. | |
| 6,200,361 | B1 | | 3/2001 | Krymsky | |
| 6,484,354 | B2 | | 11/2002 | Lee | |
| 2003/0126715 | A1 | * | 7/2003 | Krymsky et al. | 15/346 |

FOREIGN PATENT DOCUMENTS

| | | | |
|---|---|---|---|
| GB | 2338404 | * | 12/1999 |
| JP | 2001-149277 | * | 6/2001 |

OTHER PUBLICATIONS

Dust Control Handbook, Noyes Data Corporation, pp. 64-65.
US 6,631,534, 10/2003, Allen et al. (withdrawn)

* cited by examiner

*Primary Examiner*—Gary K Graham
(74) *Attorney, Agent, or Firm*—Norman E. Lehrer

(57) ABSTRACT

A vacuum cleaner with a closed loop air system is disclosed that is intended for the cleaning of soft-coated floors, such as carpets and rugs. The cleaner includes two main units: a floating foot, containing an intake nozzle and an expanded chamber for the returning air stream, and a managing unit, containing a managing handle and supporting wheels. The floating foot has a seal along its perimeter, enclosing the space between the surface being cleaned and the bottom of the foot from the surrounding space and also contains the expanded chamber for the returning air stream. The foot and managing unit are joined by a universal joint that makes the foot floating, allowing it to swing forward, back, left and right. It also guarantees that the foot is always pressed to the surface being cleaned, independent of the position of the managing unit and handle movement. This guaranteed contact prevents the escape of the air stream, as a working medium, from the closed loop system into the surrounding space. The cleaner also contains a fan, driven by an electrical motor, centrifugal air filter, and hoses or pipes for connecting the intake nozzle, fan, filter and expanded chamber. The fan with the motor and the air filter can be mounted onto the floating foot or onto the managing unit.

7 Claims, 10 Drawing Sheets

CLOSED LOOP VACUUM CLEANER

BACKGROUND OF THE INVENTION

The present invention relates to closed loop upright vacuum cleaners, which circulate air in such a way that the cleaned air is returned to the place where it was first sucked in.

DESCRIPTION OF THE PRIOR ART

All existing vacuum cleaners are a subset of a larger category of airborne dust collection systems. As shown schematically in FIGS. 1 and 2, all of these prior art systems have in common a fan 12, usually driven by some sort of an electrical motor 13, and an air filter 14, connected by various pipes or hoses 16 and 18. The fan 12 sucks in the air, polluted by airborne dirt and dust and directs this polluted air stream into the filter 14. The filter 14 retains air pollutants and releases cleaned air back into the surrounding space. The only distinction vacuum cleaners have from general dust collection systems is that they draw air only from the surface 20 being cleaned. The created air stream then picks up and conveys any particulate pollutants 22 from this surface 20 to the filter 14.

There are, however, no air filters able to retain 100% of airborne particulate pollutants. For example, most vacuum cleaners utilize a porous filter, usually in the form of disposable paper or reusable cloth bags 14 or a combination of cyclones 24 (FIG. 2) and then again a porous filter or bag 14 usually in a pleated form. However, porous filters are even theoretically unable to retain the full spectrum of dirt and dust. They inevitably release dust 26 finer than the filter's pores back into the surrounding atmosphere. This minute dust is the most hazardous for humans, as it can saturate the air in the room for long periods of time before settling. Furthermore, it is also harmful for any household electronic devices such as televisions, computers, etc. Thus, in existing vacuum cleaners, the air used to pick up and transport dirt and dust from the surface being cleaned to the filter, always contains some amount of dust even after filtration. Preventing the escape of such polluted air into the surrounding atmosphere is the main purpose of the present invention.

There are vacuum cleaners known in the art that recycle the air after being filtered. As shown in FIG. 3, they commonly have a channel 28 in the form of a pipe or hose and jet nozzles 30 and 32 for returning the cleaned air to the proximity of the intake nozzle 34. Such prior art devices are shown, for example, in U.S. Pat. Nos. 3,694,848; 4,884,315; 5,553,347; 5,613,269; 6,032,327 and 6,631,534. In the majority of these patents, the object of returning the air stream and directing it at the cleaned surface is to improve the cleaner's cleaning ability, using the energy of the returning air stream to tear up dirt and dust embedded in the surface being cleaned, usually carpet. In U.S. Pat. No. 5,553,347, the object of returning the air stream is to lift the upright vacuum cleaner above the cleaning surface, in order to make it easier to move and maneuver during its operation.

In all of these cleaners the returning air can potentially be sucked back into the cleaner via the intake nozzle, thus preventing this air filled with the finest dust from saturating the surrounding environment. Such cleaners can be considered closed-loop airflow systems, schematically illustrated in FIG. 4. However, if such a system has even a single gap, it becomes impossible to prevent the air from at least partly escaping into the surrounding atmosphere, thus defeating the very purpose of a closed loop cleaner: fully preventing the escape of air as a working medium of the closed loop vacuum cleaner. Even if the gap is such that the axes of the blowing outlet and the sucking outlet lie on the same line, some portion of the air stream will manage to escape such as shown in FIG. 5. The rate of air wastage depends on the distance (L) between the returning nozzle 30 and intake nozzle 34, the angle (A) between them, their cross sectional areas, and the velocity (V) of the air stream, all of which is illustrated in FIG. 6.

The first reason for the loss of air, as a working medium, from the closed loop systems described in the mentioned above prior art patents, is the open gap between the outlet (returning) nozzle and the intake nozzle. This gap is bounded by the cleaning surface and the bottom of the cleaner and, is always open along its perimeter as shown, for example, in FIG. 3 and in U.S. Pat. Nos. 3,694,848; 5,553,347; 5,613,269 and 6,032,327.

The second reason for the loss of air stream, described in the above mentioned patents, is an increased velocity of the returning air stream caused by the use of jet nozzles as returning outlets. Most of the cleaners described in the above prior art patents use air jets as outlet nozzles in order to increase the velocity, and therefore force, with which the air hits the cleaning surface, in order to better its ability to tear at the dirt. These jet openings have a smaller cross sectional area compared to the returning channel, which increases the velocity of the discharging air stream. The jets can be round (U.S. Pat. No. 3,694,848), slotted (U.S. Pat. Nos. 5,168,599; 6,032,327; 6,631,534) or have other shapes.

The important factor of the prior art is that the cross sectional area of the discharging jets (returning nozzles) is always smaller than the cross sectional area of the intake nozzle, as illustrated, for example, in U.S. Pat. No. 4,884,315 (FIG. 3). However, as was mentioned above, increasing the velocity of the returning air stream also increases its seepage into the surrounding atmosphere. This wasted air, polluted with the finest dust not retained by the filter, then flows back into the air, saturating the room. This is the first source of the airborne dust that saturates the working space of the cleaner. Also, directed toward the surface being cleaned, the returning air stream uses its increased velocity to blow dirt and dust from this surface, which is only partially sucked in by the intake nozzle, with the rest saturating the surrounding space through the open perimeter around the cleaner's bottom. This is the second source for the polluting air surrounding the cleaner.

The inevitable loss of air as a working medium of the known closed loop cleaners restricts the choice of air filter to only porous filters. Such filters, being unable to retain the entire spectrum of particulate pollutants, also pose great aerodynamic resistance, essentially diminishing the air stream velocity in the closed loop system. Although this diminishes the loss of air stream, at the same time it diminishes the air stream velocity in the intake nozzle, which substantially decreases the cleaning ability of the cleaner or its ability to pick up and convey dirt and dust. To overcome the resistance of porous filters, cleaners are forced to have relatively large electrical motors, driving the fan. This makes cleaners heavy and more energy consuming.

There is, therefore, a need in the art for a closed loop system that is lighter in weight, more efficient and which does not discharge dust laden air back into the atmosphere.

SUMMARY OF THE INVENTION

The present invention is designed to overcome the deficiencies of the prior art discussed above. It is an object of the present invention to provide a closed loop vacuum cleaner, with the minimum exhaust of the air used as a working medium in the cleaner and still polluted by the finest contaminants into the surrounding atmosphere, as well as the minimum uplift of dirt and dust on the surface being cleaned, usually caused by the surface-directed returning air stream.

It is another object of the present invention to provide a device which uses the same portion of air to pick up dirt from the surface being cleaned, transport the particulate pollutants to the filter, and then to return this air to the intake nozzle, minimizing its escape from the closed loop vacuum cleaner system to virtually none.

It is a further object to diminish the energy consumption of the cleaner and make the cleaner lighter, by reducing the aerodynamic resistance to the air flow in the closed loop system, which allows for a smaller and lighter motor.

It is an even further object of the present invention to increase the cleaning ability of the vacuum cleaner by increasing the air stream velocity in its intake nozzle while diminishing the motor's power.

It is a still further object of the present invention to provide the vacuum cleaner with a lower weight and energy consumption, by using a centrifugal air filter with low aerodynamic resistance and high air stream velocity.

An even further object of the present invention to provide a vacuum cleaner, which allows for a more efficient way to clean surfaces due to an increased air stream velocity at the intake nozzle.

In accordance with the illustrative embodiments demonstrating the features and advantages of the present invention, there is provided a vacuum cleaner with a closed loop air system. The cleaner is intended for the cleaning of soft-coated floors, such as carpets and rugs. The cleaner includes two main units: a floating foot, containing an intake nozzle and an expanded chamber for the returning air stream, and a managing unit, containing a managing handle and supporting wheels. The floating foot has a seal along its perimeter, enclosing the space between the surface being cleaned and the bottom of the foot from the surrounding space. The foot also contains the expanded chamber for the returning air stream. This chamber diminishes the velocity and the specific energy of the returning air stream.

The foot and managing unit are joined by a universal joint that makes the foot floating, allowing it to swing forward and back and left and right. It also guarantees that the foot is always pressed to the surface being cleaned by its weight, independent of the position of the managing unit and the managing handle movement. This provides guaranteed contact between the foot's seal and the surface being cleaned, preventing the escape of the air stream, as a working medium, from the closed loop system into the surrounding space. The seal, the expended chamber and floating foot are intended for preventing the escape of air stream from the closed loop system into the surrounding space.

The cleaner also contains a fan, driven by an electrical motor, centrifugal air filter, and hoses or pipes for connecting the intake nozzle, fan, filter and expanded chamber. The fan with the motor and the air filter can be mounted onto the floating foot or onto the managing unit.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
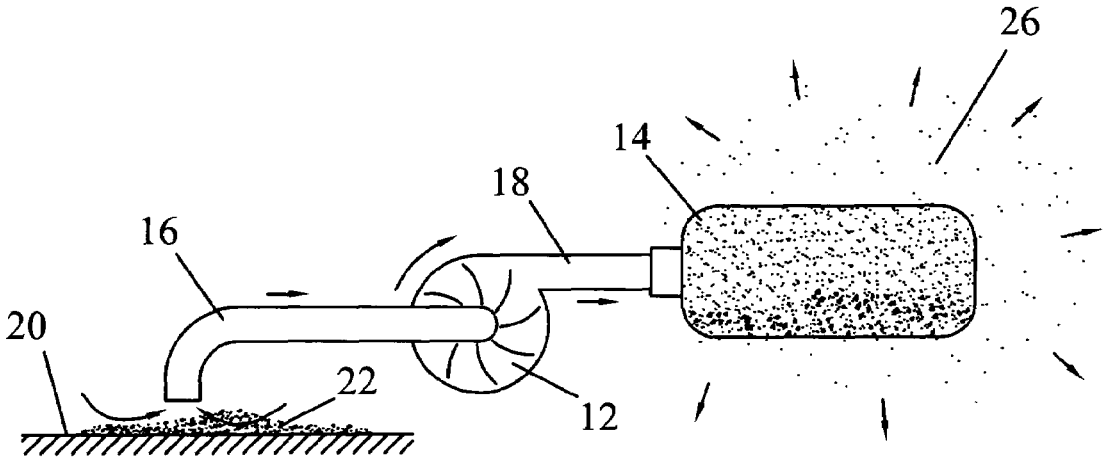
Fig.1 ( Prior art )
FIG. 1 is a schematic representation of prior art conventional vacuum cleaners with porous filters.
Figure 2:
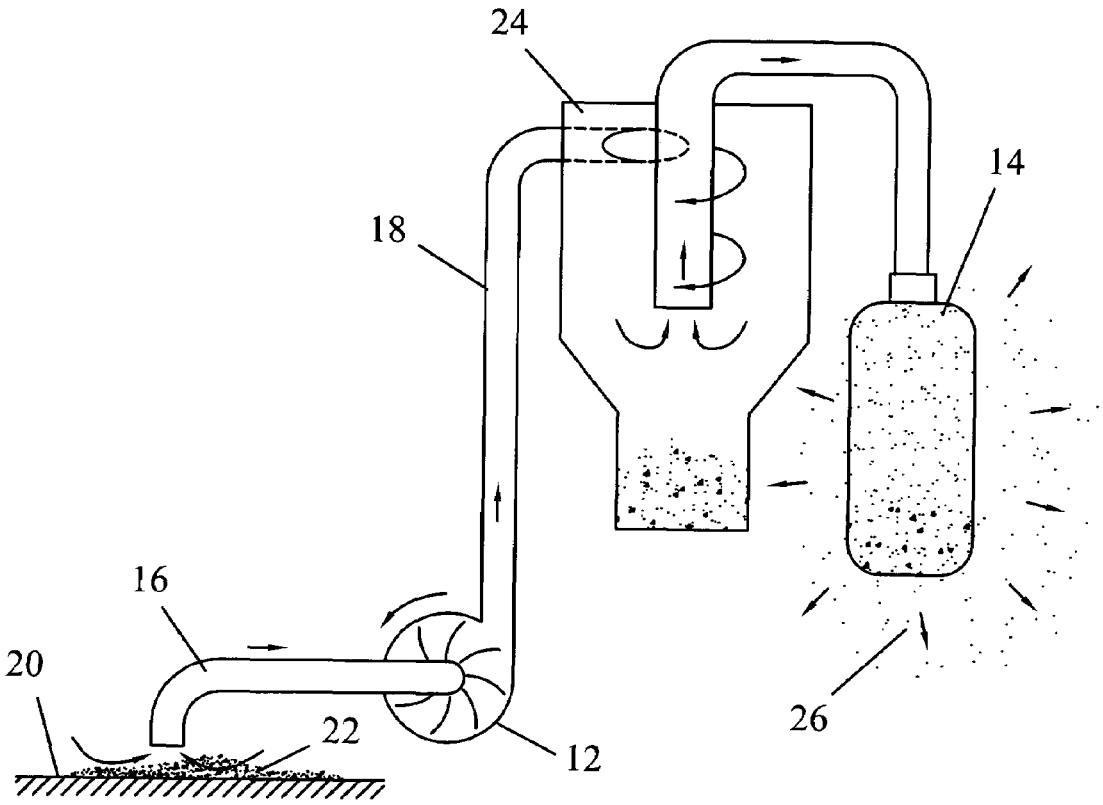
Fig.2 ( Prior art )
FIG. 2 is a schematic representation of conventional vacuum cleaners with centrifugal and porous filters.
Figure 3:
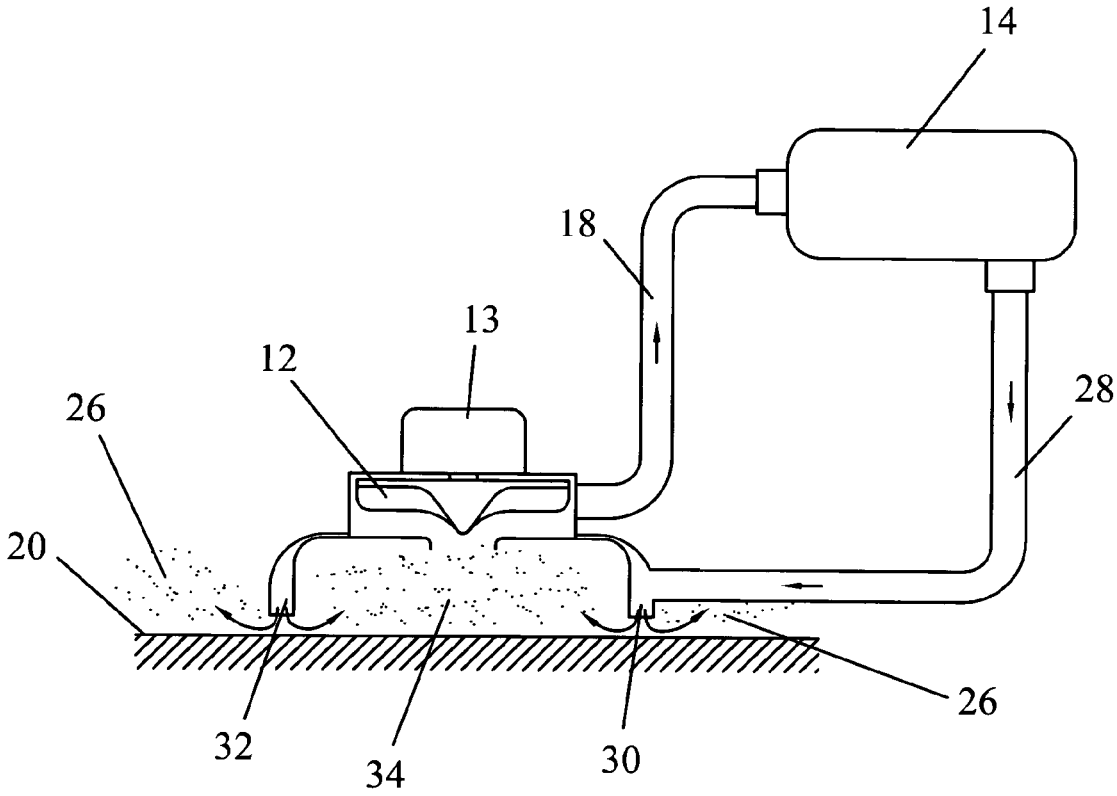
Fig.3 ( Prior art )
FIG. 3 is a schematic representation of known prior art closed loop vacuum cleaners.
Figure 4:
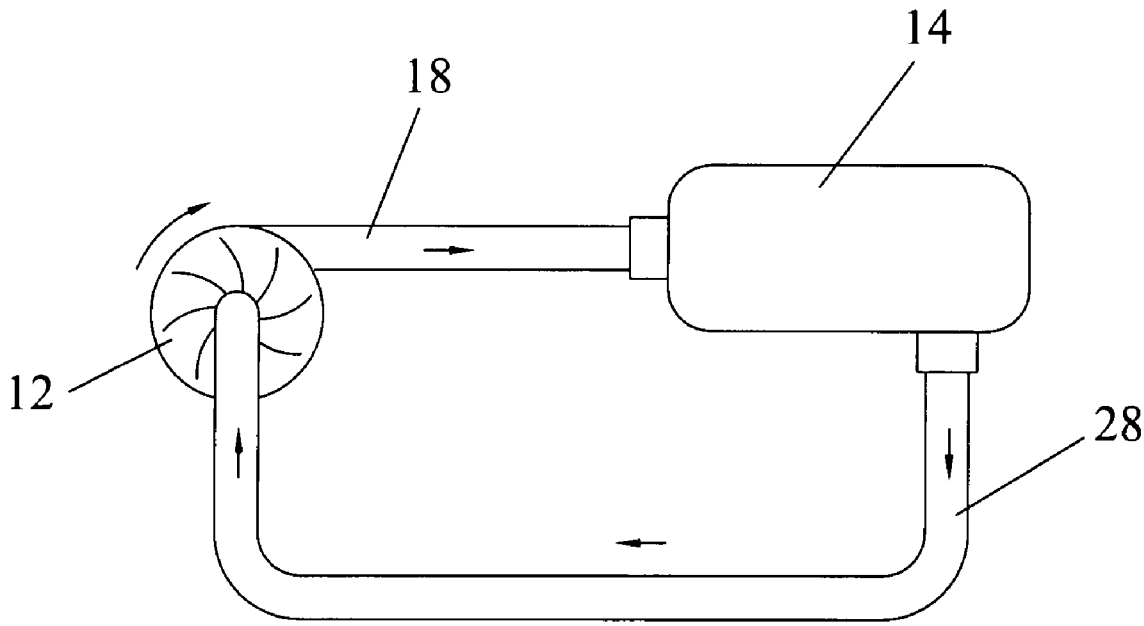
Fig.4 ( Prior art )
FIG. 4 is a schematic representation of a closed loop airflow system.
Figure 5:
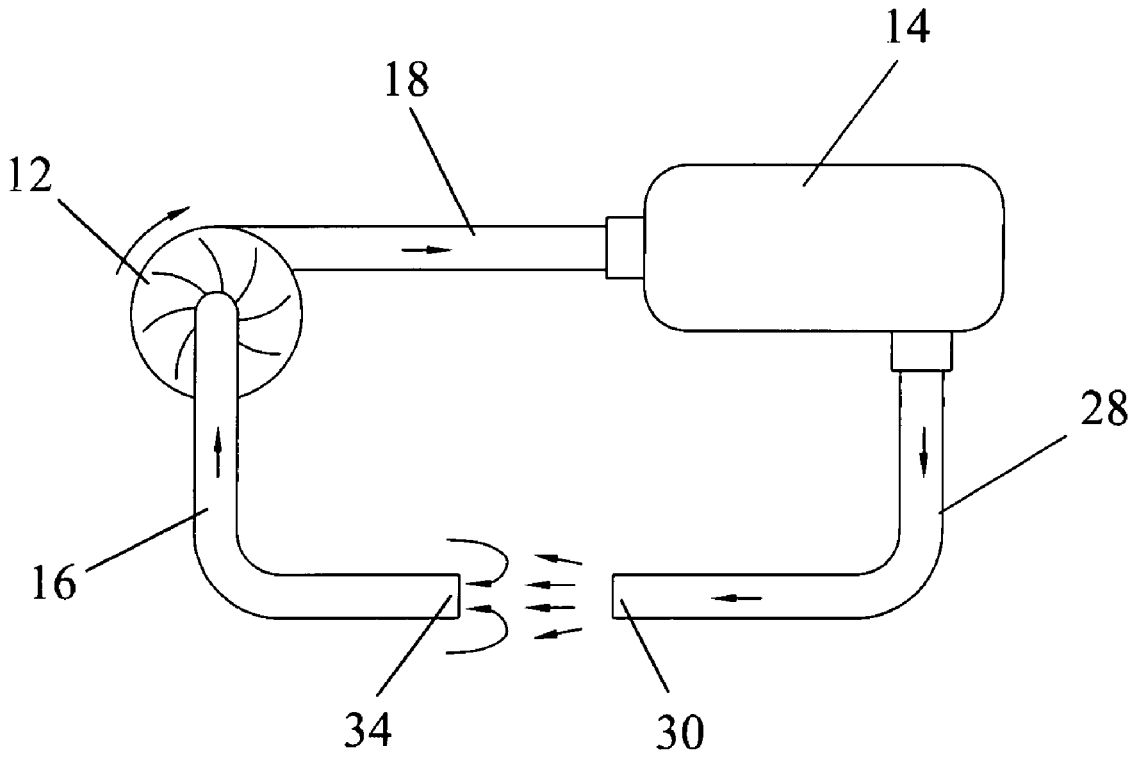
Fig.5 ( Prior art )
FIG. 5 is a schematic representation of a closed loop vacuum system illustrating the gap created when the blowing outlet and the sucking outlet are aligned along the same line.
Figure 6:
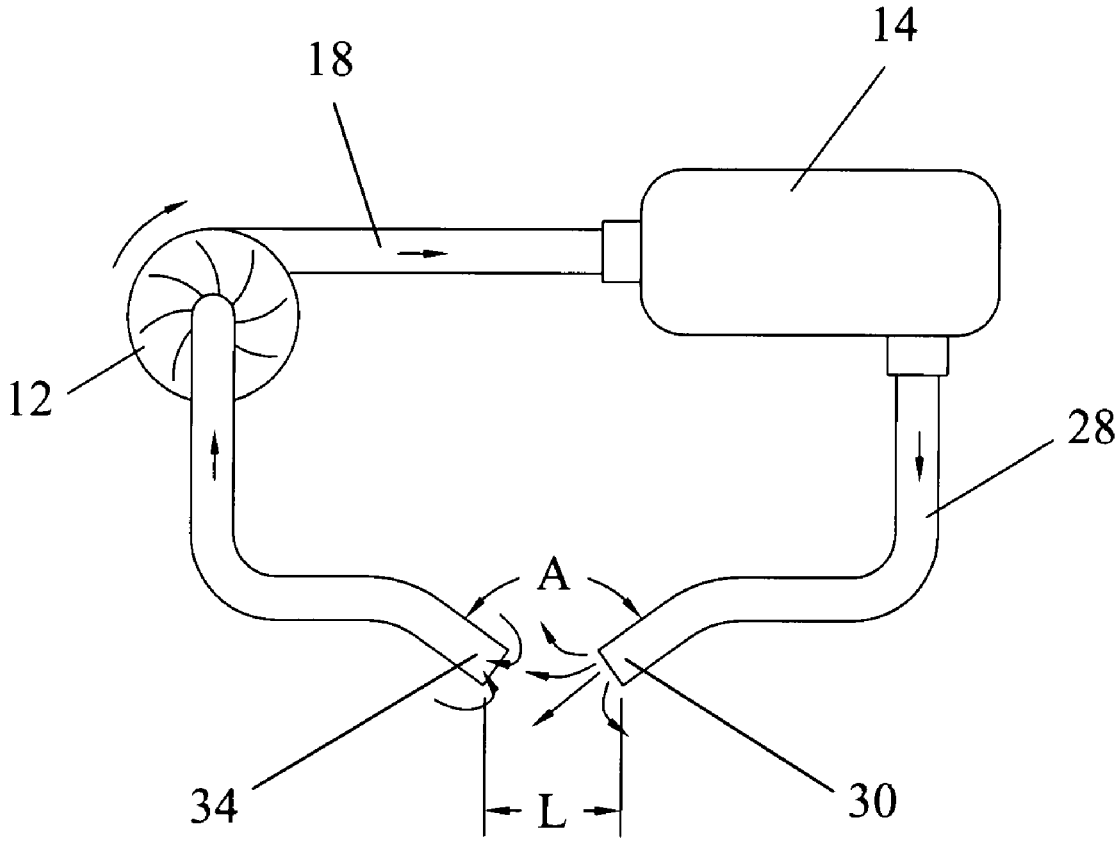
Fig.6 ( Prior art )
FIG. 6 is a schematic representation of a closed loop vacuum system similar to FIG. 5 illustrating the gap created when the axes of the blowing outlet and the intake outlet are aligned at an angle with respect to each other.

Referring now to the drawings in detail where like reference numerals have been used throughout the various drawings to designate like elements, there is shown in FIGS. 7, 8, 9, 10, 11 and 12 an upright vacuum cleaner constructed in accordance with the principles of the present invention an illustrated generally as 110. As should be readily apparent to those skilled in the art, the vacuum cleaner of FIGS. 7, 8, 9, 10, 11 and 12 is shown diagrammatically only. That is, many of the features thereof are conventional and the details are, therefore, not believed necessary for a full understanding of the invention. As will also be readily apparent to those skilled in the art, many of the individual elements of the inventive vacuum cleaner are the same as of similar to those of the prior art. For convenience, many of the elements shown in FIGS. 1-6 are identified by similar reference numerals in FIGS. 7-12 but are preceded by the numeral 1. For example, the fan shown in FIGS. 1-6 is identified as fan 12, while in FIGS. 7-12, the fan is identified as fan 112.

The vacuum cleaner of the present invention essentially includes a closed loop air system which contains an intake nozzle 134, a fan 112, driven by electrical motor 113, a filtering unit 114, and a returning expanded chamber 136. All are connected in the closed loop system by hoses and/or pipes 116, 118 and 128. The filtering unit may be a centrifugal filtering unit and the expanded chamber may be sealed.

The vacuum cleaner has two main components. One of them is a foot 138 containing the intake nozzle 134, the outlet nozzle 130, and the expanded chamber 136 for the returning air stream. The second, the managing unit, has a frame 140 on supporting wheels 142 and a handle 144 for managing the vacuum. The fan 112 with the motor 113 and the filtering unit 114 can be placed on either one. In the embodiment shown in FIGS. 7, 8 and 9, fan 112 and motor 113 are mounted on the frame 140 of the managing unit. The filtering unit 114 is also mounted on the frame 140 via an upright support 146 and brackets 148. The intake nozzle 134, fan 112, filtering unit 114, outlet nozzle 130, and expanded chamber 136 are connected in the closed loop system by hoses and pipes 116, 118 and 128.

The vacuum cleaner works in the following way. The fan 112 sucks in the air through the intake nozzle 134 from the expanded chamber 136. The created air stream picks up the dirt and dust from the surface 120 being cleaned. Then the polluted air stream goes through channel 150 and the flexible hose 116 to fan 112. The fan 112 directs this stream through the pipe 118 to the filtering unit 114. After filtering, the cleaned air stream goes through the pipe and the flexible hose 128 and outlet nozzle 130 to the expanded chamber 136. In this chamber, the air stream, due to its widening, decreases its velocity, and then all the returned air is sucked in through the intake nozzle, picking up a new portion of dirt and dust from the surface being cleaned. Thus, the proposed vacuum cleaner realizes the closed loop air system without a gap, shown in FIG. 4.

To prevent the returning air stream from escaping into the atmosphere, the foot has a seal along its perimeter, which separates the space under the foot's bottom from the surrounding space. This seal can have several different designs. It can be a combination of the foot's support skids 152 and 154 on the front and back sides and thin vertical walls 156 and 158 enclosing the expanded chamber 136 on the left and right-hand sides. In addition to preventing the escape of the air stream from the expanded chamber, the elements of the seal serve a secondary purpose. Weighed down by the weight of the foot 138, they compress the soft pile 160 of the rug or carpet being cleaned (FIGS. 10 and 11) making it denser and less penetrable by the air stream, further ensuring against the escape of air from the chamber. The seal can also have some other shape or design.

The second measure intended to prevent the escape of air as a working medium from the closed loop system into the surrounding space is the expanded chamber 136, placed in the foot 138, above and in direct fluid communication with the surface being cleaned. The expanded chamber has a much larger cross section than the outlet nozzle 130. The returning air stream enters this chamber through the outlet nozzle 130 in sequence after the filtering unit 114. The expanded chamber 136 increases the cross section of the returning air stream, diminishing its velocity in the space enclosed by the seal, which in turn decreases its specific energy and its dynamic pressure on this seal.

Compared to known closed loop cleaners, which narrow the outlet for returning air and therefore increase the velocity of this air, the closed loop system of the present invention proposes the exact opposite: to widen the outlet for the returning air via the expanded chamber and then narrow the intake nozzle, therefore increasing the velocity of the air being sucked. This difference has two main effects. Because the velocity with which the air is blown out is lower, the air exerts less pressure on the seal. Because the velocity with which the air is sucked in is greater, the cleaner's suction ability is enhanced.

Thus, in contrast to known prior art cleaners utilizing a closed loop system, the increase in the air stream velocity is reached via a regional increase in air stream velocity at the entrance to the intake nozzle in our closed loop system, rather than a regional increase in the returning air stream velocity via outlet jet nozzles in known systems.

The third measure intended to prevent the escape of air from the closed loop cleaner is the universal joint between the foot and the managing unit. The universal joint allows the foot to be floating, which allows it to swing forward and back and left and right, independent of the position and inclination of the managing unit and the tilt of the management handle. As a result, the foot freely lies on the surface being cleaned, pressed to this surface by only its own weight. The universal joint ensures constant contact of the foot's seal with the surface being cleaned. It also allows the foot to closely follow any irregularities in the surface being cleaned and ensures a constant optimal gap between the surface being cleaned and the entrance of the intake nozzle.

The universal joint can have many possible implementations. For example, the foot 138 can be mounted on the fork 162 via two hinges 164 and 166 allowing the foot to swing forward and back. The fork 162, in turn, is mounted on the frame 140 of the managing unit via hinge 168, allowing the fork to swing together with the foot 138 from left to right. Between the managing handle 144 and the foot 138 can be several universal joints. For example, the hinge between the handle 144 and the frame 140 also increases the level of the foot's independence from the position and tilt of the handle 144.

Figure 7:
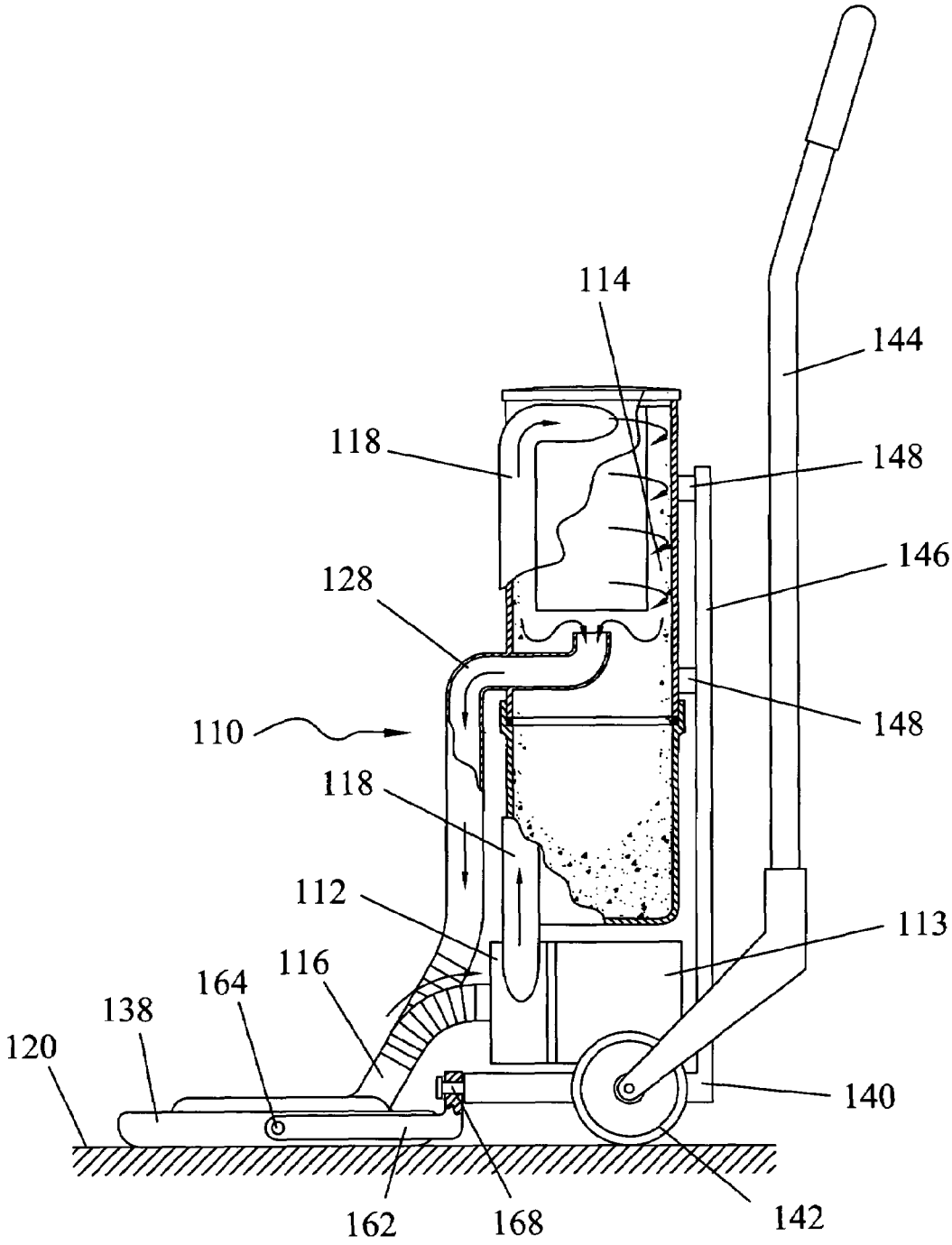
FIG. 7 is a side elevational view, shown partially in cross-section, of the improved closed loop vacuum cleaner of the present invention.
Figure 8:
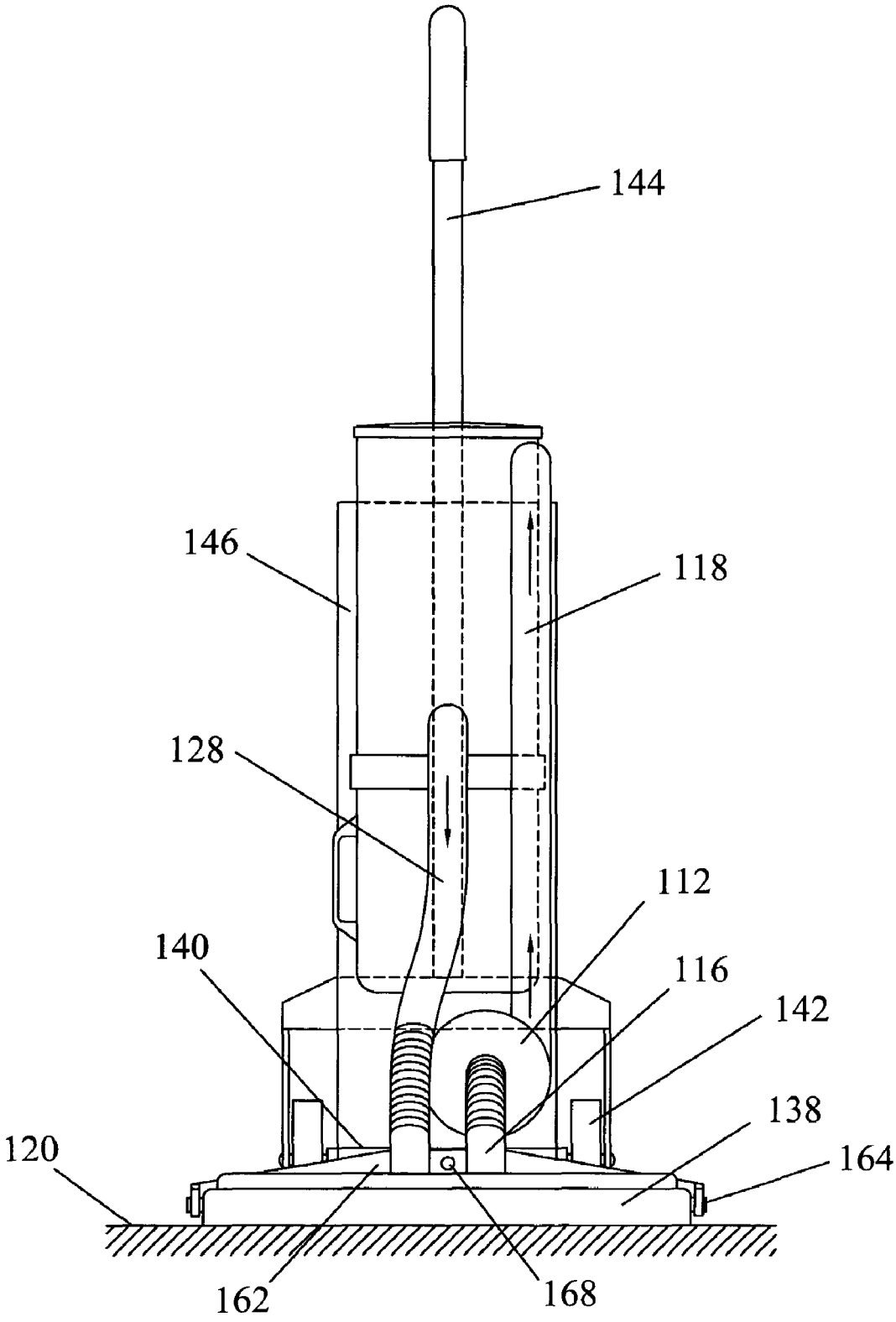
FIG. 8 is a front elevational view of the improved closed loop vacuum cleaner of FIG. 7.
Figure 9:
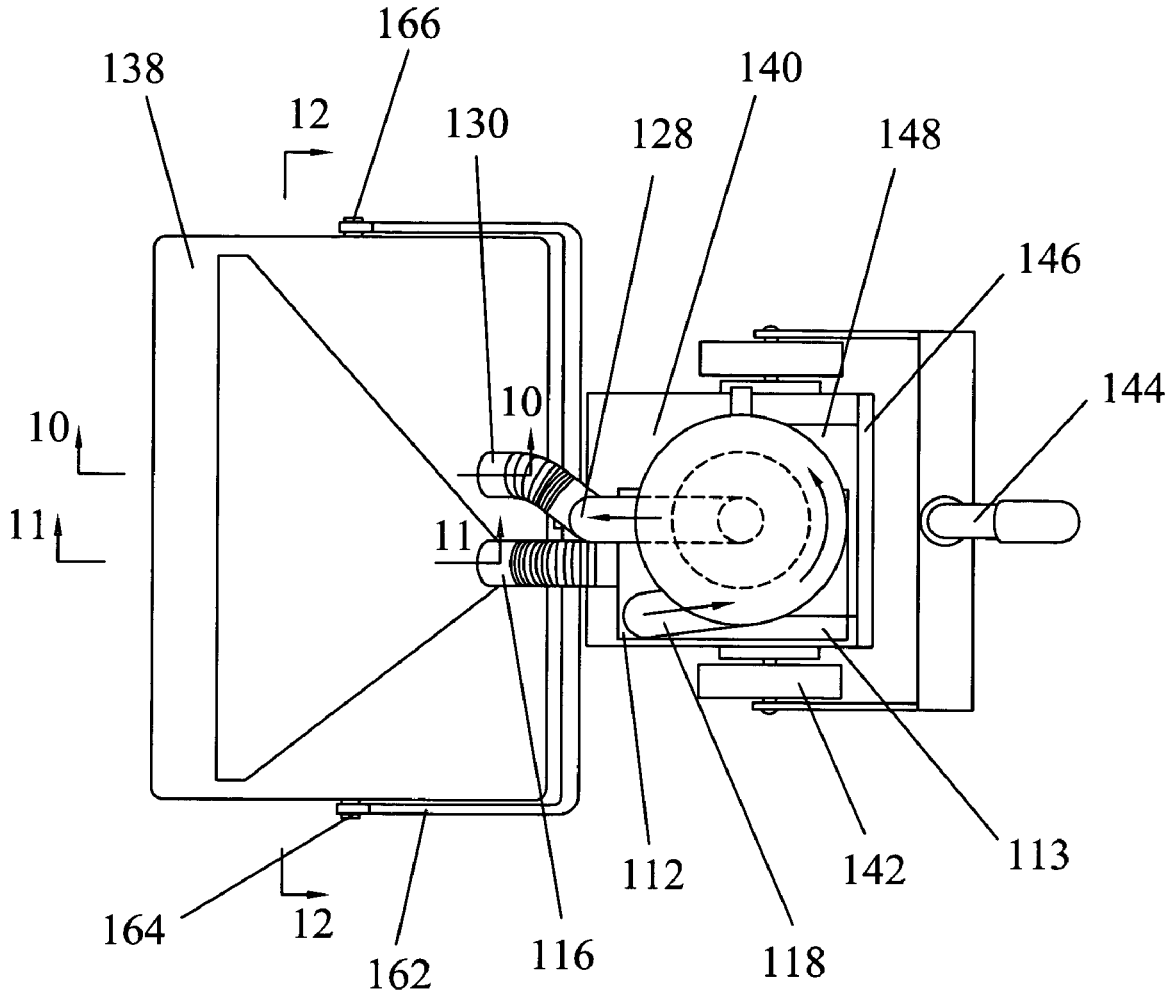
FIG. 9 is a top plan view.
Figure 10:
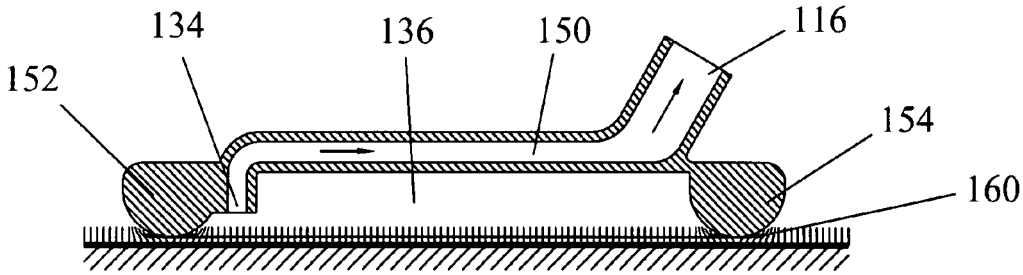
FIG. 10 is a cross-sectional view taken through the line 10-10 of FIG. 9.
Figure 11:
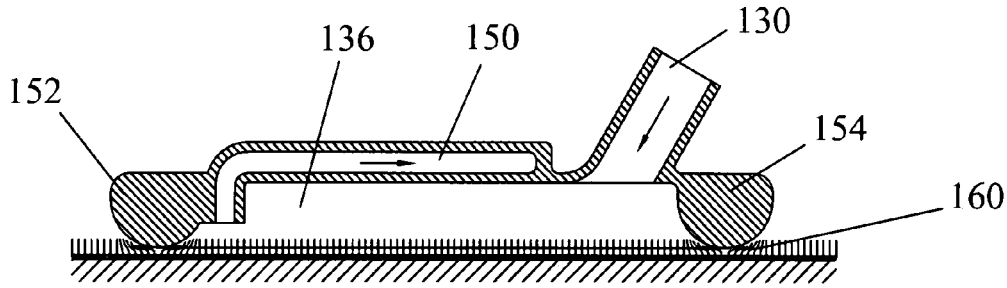
FIG. 11 is a cross-sectional view taken through the line 11-11 of FIG. 9.
Figure 12:
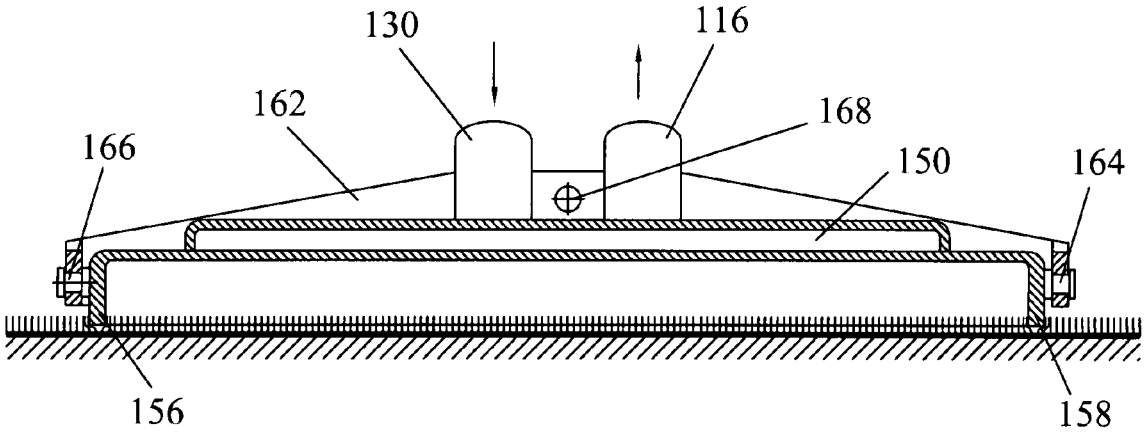
FIG. 12 is a cross-sectional view taken through the line 12-12 of FIG. 9.

Because in the embodiment shown in FIGS. 7, 8 and 9, the fan 112 and filter 114 are mounted on the managing unit, the hoses connecting the intake and outlet nozzles in the foot 138 with the fan and the filtering unit must be flexible to make the position of the foot 138 independent of the position and possible tilting of the managing unit.

The seal around the cleaning zone, the expanded chamber, and the independent foot's suspension via the universal joint, prevent the escape of air as a working medium from the closed loop air system cleaner, and therefore allow an increase in the average air stream velocity in it. This, in turn, increases the air stream velocity in the intake nozzle and therefore the cleaning ability of the cleaner, as its ability to pick up and transport particulate matter from the surface being cleaned.

The increased average air stream velocity is reached by using low-aerodynamic-resistance, high-air-stream-velocity centrifugal filters as filtering units. These can be traditional cyclones such as described in the literature (see, for example, Dust Control Handbook published by Noyes Data Corporation) or other known centrifugal filters such as described, for example, in U.S. Pat. Nos. 4,853,008; 5,908,493 and 6,200,361. The centrifugal air filter shown in FIGS. 7, 8 and 9 is a known version of a classical cyclone. Using centrifugal filters without additional in-line porous filters gives the closed loop cleaner one more important advantage. Such low aerodynamic resistance filters make it possible to increase the air stream velocity in the closed loop system, while at the same time using a smaller, lighter, and less energy consuming motor driven fan.

The present invention may be embodied in other specific forms without departing from the spirit or essential attributes thereof and accordingly, references should be made to the appended claims rather than to the foregoing specification as indicating the scope of the invention.

We claim:

1. A closed loop vacuum cleaner for cleaning a floor surface comprising:

a managing unit containing a handle and support wheels;

a foot portion supported by said managing unit and containing an expanded chamber therein, said foot portion further including an intake nozzle and an outlet nozzle directed toward said chamber, the cross section of said outlet nozzle being larger than the cross section of said intake nozzle, thereby increasing the velocity of air at said intake nozzle while decreasing the velocity of air at said outlet nozzle;

a motor driven fan for creating air flow, said motor driven fan being supported by one of said foot portion and managing unit and being connected to said intake nozzle and said outlet nozzle to form a closed loop air system with said expanded chamber;

means within said closed loop air system for filtering dirt and pollutants from the air within the system; and a universal joint between said foot portion and said managing unit to thereby allow said foot portion to float above the floor surface being cleaned.

2. The closed loop vacuum cleaner of claim 1 wherein said floating foot portion includes a seal around the perimeter thereof to close off the space between the surface being cleaned and the bottom of said foot portion from the surrounding space.

3. The closed loop vacuum cleaner of claim 1 wherein said filtering means includes a low aerodynamic resistant high air stream velocity centrifugal filter.

4. A closed loop vacuum cleaner for cleaning a floor surface comprising:

a foot portion containing an expanded chamber therein, said foot portion further including an intake nozzle and an outlet nozzle directed toward said chamber;

a managing unit containing a handle and support wheels;

a motor driven fan for creating air flow, said motor driven fan being supported by one of said foot portion and managing unit and being connected to said intake nozzle and said outlet nozzle to form a closed loop air system with said expanded chamber;

means within said closed loop air system for filtering dirt and pollutants from the air within the system; and a universal joint between said foot portion and said managing unit to thereby allow said foot portion to float above the floor surface being cleaned, wherein said expanded chamber is located between said intake nozzle and said outlet nozzle and overlies and is in direct fluid communication with the floor surface being cleaned.

5. The closed loop vacuum cleaner of claim 4 wherein the cross section of said outlet nozzle is larger than the cross section of said intake nozzle, thereby increasing the velocity of air at said intake nozzle while decreasing the velocity of air at said outlet nozzle.

6. The closed loop vacuum cleaner of claim 4 wherein said floating foot portion includes a seal around the perimeter thereof to close off the space between the surface being cleaned and the bottom of said foot portion from the surrounding space.

7. The closed loop vacuum cleaner of claim 4 wherein said filtering means includes a low aerodynamic resistant high air stream velocity centrifugal filter.

* * * * *